US005472308A

United States Patent [19]

Somero

[11] Patent Number: 5,472,308

[45] Date of Patent: Dec. 5, 1995

[54] GRAPPLE MOUNT

[76] Inventor: Nick J. Somero, Rte. 1, Box 133, Raymond, Wash. 98577

[21] Appl. No.: 233,396

[22] Filed: Apr. 26, 1994

[51] Int. Cl.[6] ..... E02F 5/00

[52] U.S. Cl. ..... 414/724; 414/912; 37/406

[58] Field of Search ..... 414/724, 729, 414/912; 37/403, 406

[56] References Cited

U.S. PATENT DOCUMENTS

| | | | |
|---|---|---|---|
| 4,466,494 | 8/1984 | Hanson | 37/403 X |
| 4,519,739 | 5/1985 | Risch | 414/724 |
| 5,150,936 | 9/1992 | Avery | 414/912 X |

*Primary Examiner*—Donald W. Underwood

*Attorney, Agent, or Firm*—Brian J. Coyne

[57] ABSTRACT

A mount for attaching a grapple to an excavator arm equipped with a hydraulic drive, a thumb, and a bucket. A rear portion of the mount is adapted to overlie the thumb to which it is attachable by bolts. A forward portion of the mount is provided with apertured ears that attach by pins to interior fingers of the thumb. The mount includes a second pair of apertured ears that extends forwardly from the thumb and to which a grapple is attachable by a drop link. The hydraulic system of the excavator is modified to permit diversion of the hydraulic drive for the thumb to the grapple when the grapple is mounted on the excavator. The grapple mount significantly reduces the time necessary for mounting and dismounting a grapple to an excavator arm because it eliminates the necessity for mounting and dismounting the thumb and the bucket.

5 Claims, 7 Drawing Sheets

GRAPPLE MOUNT

BACKGROUND OF THE INVENTION

1. Field of the Invention

This invention relates to grapples, and more specifically to apparatus for mounting grapples to the articulated boom of an excavator.

2. Description of the Prior Art

An excavator equipped with a hydraulically-actuated boom, an arm attached to the boom, and a thumb and bucket attached to a free end of the arm, is commonly used in road clearing operations, particularly in forested regions. The bucket is used for digging up soil and removing debris from the surface of the ground. After trees have been felled as part of a road clearing process, the logs may be grasped and removed by the thumb; unfortunately, the logs are often broken or crushed in the process. A grapple mounted on the end of the arm provides a superior means for grasping and lifting logs. In the prior art, however, it has been necessary to remove both the thumb and the bucket from the end of the arm in order to mount a grapple, which is a time-consuming procedure. It is desirable, therefore, to provide apparatus for attaching a grapple on the end of the arm of an excavator without the necessity of having to remove either the thumb or the bucket. When an excavator is equipped with such an apparatus, including a grapple mount and a hydraulic drive system suitably modified to actuate a grapple attached to the grapple mount, it is possible to continuously and rapidly alternate between removal of logs and stumps using a grapple and removal of soil and debris using a bucket.

SUMMARY OF THE INVENTION

The present invention overcomes the problems outlined above and provides apparatus for attaching a grapple to hydraulically actuated articulated boom of an excavator equipped with both a thumb and a bucket, without requiring the removal of either the thumb or the bucket. The apparatus of the invention includes a detachable grapple mount for attaching a grapple to an arm of the excavator. A thumb pin is provided for attaching one end of the grapple mount to the thumb, and a drop link is provided at an opposite end of the grapple mount for suspending a grapple. The apparatus further includes a first diverter valve for diverting hydraulic fluid alternately to the thumb or to the grapple. A second diverter valve, connected by flexible conduit to the first diverter valve, is also provided for diverting hydraulic fluid alternately through a path that actuates opening and closing movements of the grapple or through a path that actuates rotational movements of the grapple. In a preferred embodiment wherein the diverter valves are electrically actuated, an electric power source is provided, and electric control switches are mounted inside the excavator cab for controlling the diverter valves.

DESCRIPTION OF THE PREFERRED EMBODIMENT

Figure 1:
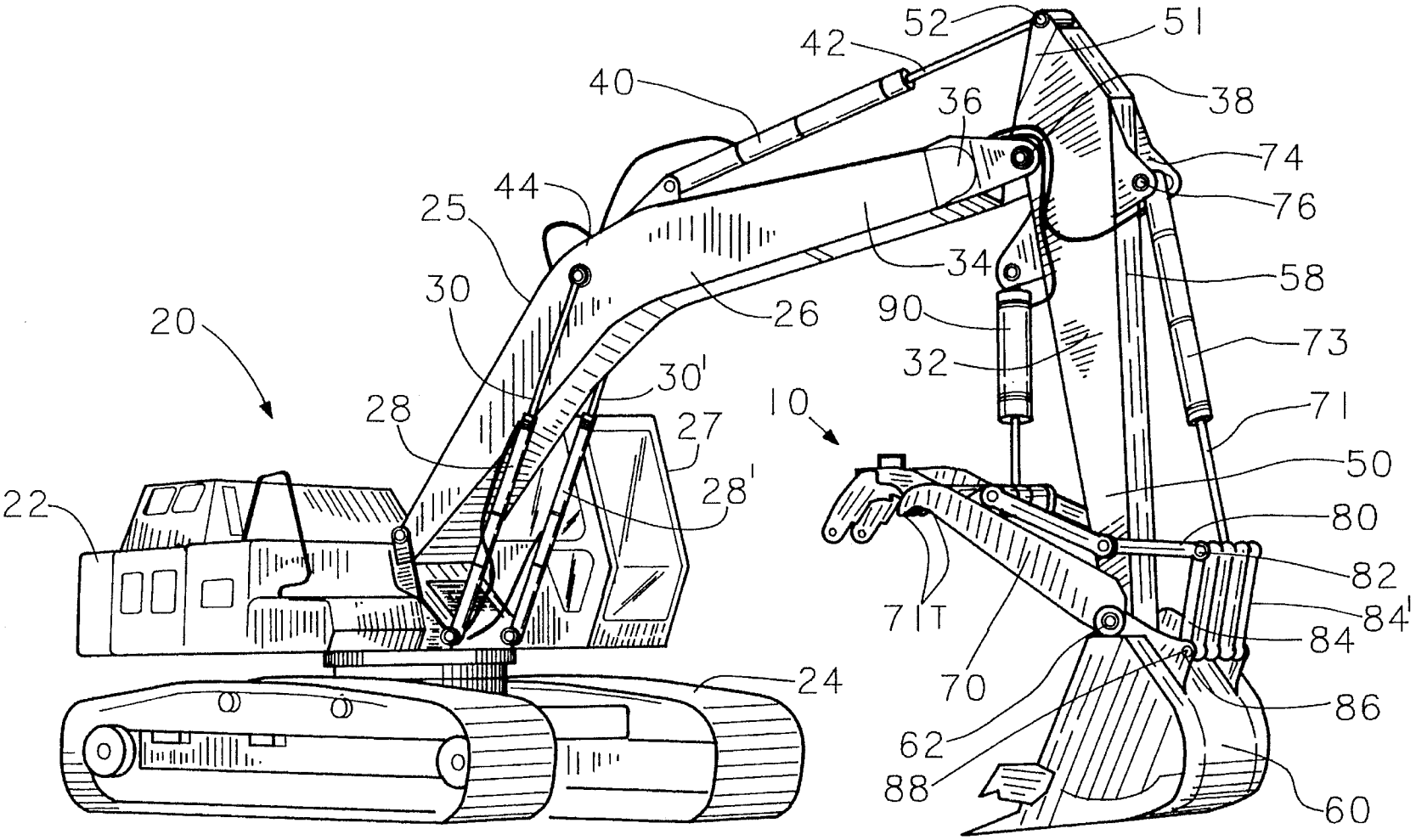
FIG. 1 is a frontal perspective view of an excavator equipped with a bucket, shown in lowered position, and a thumb, shown in raised position, and with a grapple mount attached to the thumb.

Referring now to the drawings, a grapple mount according to the present invention is illustrated in FIG. 1 and shown generally by reference numeral 10. Grapple mount 10 is shown mounted on an excavator 20, e.g., a model 790D-LC manufactured by the John Deere Company of Moline, Illinois, which includes a body 22 mounted on treads 24. A cab 27 is mounted on a front portion of the body 22. A boom 25 is carried by the body 22, from which it extends forwardly and with which it swings about a vertical axis with respect to the treads 24 in response to activation of control levers by an operator in the cab 27. A parallel pair of hydraulic boom cylinders 28, 28', which include pistons (not shown) and piston rods 30, 30', are each connected at one end to a front portion of the body 22 and at an opposite end to a central portion of the boom 26. A forward portion of the boom 34 is fitted with a clevis 36 to which an arm 32 is pivotally mounted by arm pin 38 for rotation about a horizontal axis. An arm cylinder 40 comprising a piston (not shown) and a piston rod 42 is attached to an upper surface 44 of a central portion 26 of the boom 25 with the piston rod 42 thereof pivotally connected by drive pin 52 to a rear clevis 51 of the arm 32 that extends rearward from pin 38. A forward portion 50 of the arm 32 is fitted with a transverse pin boss (not shown) for pivotally mounting by bucket pin 62 both a bucket 60 and a thumb 70 for rotation about a common horizontal axis. That is, by removing bucket pin 62 either the bucket 60 or the thumb 70, or both, may be removed from the arm 32.

A bucket cylinder 73 comprising a piston (not shown) and a bucket cylinder rod 69 is pivotally attached by bucket drive pin 76 to a bucket drive clevis 74 mounted on an upper surface 58 of the arm 32. A parallel pair of arm linkage bars 80, 80' each have one end pivotally connected to a front portion 50 of arm 32 and an opposite end connected to the bucket cylinder rod 69 by linkage pin 82. A parallel pair of bucket linkage bars 84, 84' each have one end pivotally attached to a bucket control clevis 86 by bucket control clevis pin 88 and an opposite end attached to linkage pin 82.

Figure 2:
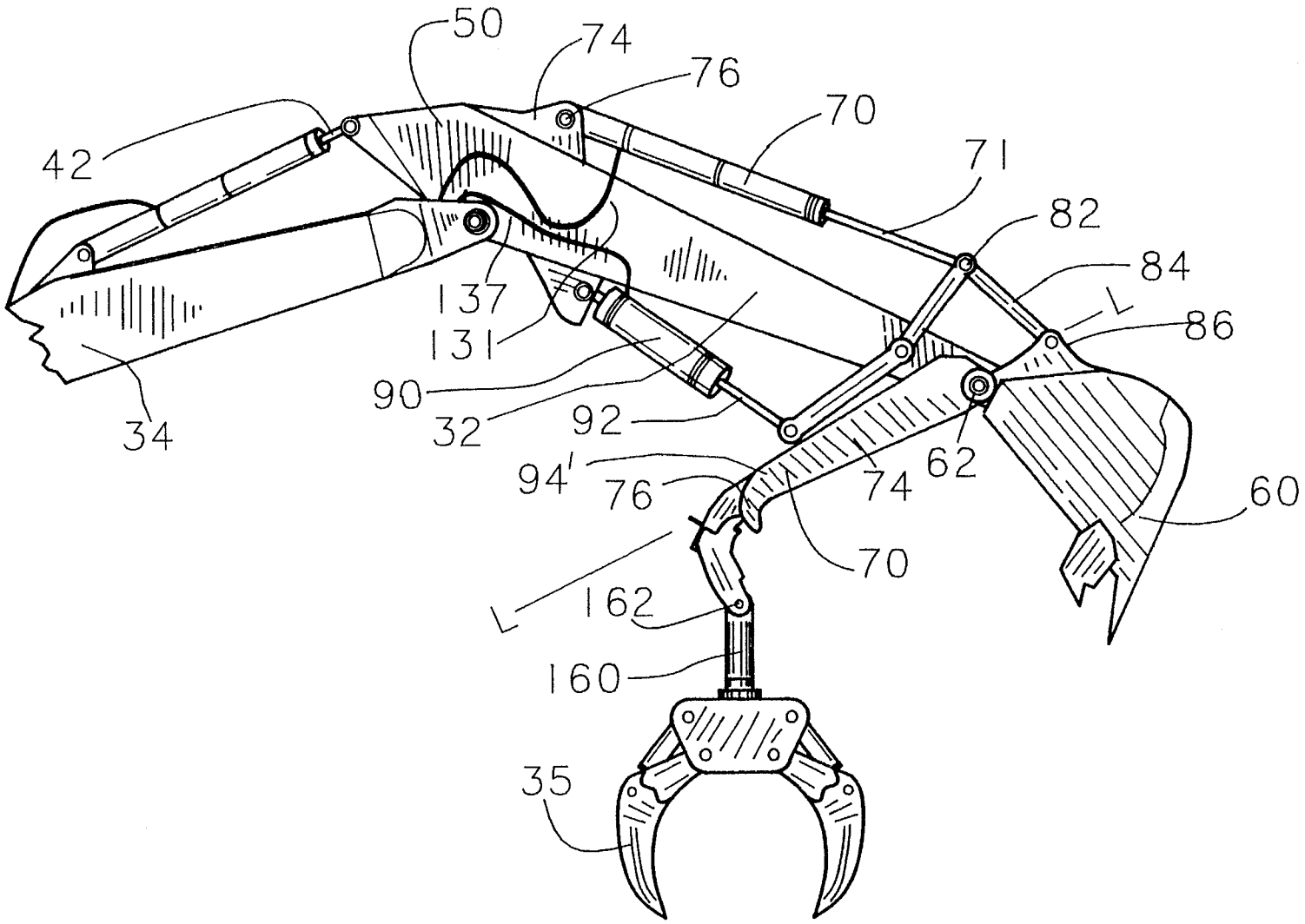
FIG. 2 is an enlarged side elevational view of an excavator showing the bucket in raised position and a grapple suspended by a drop link from a grapple mount attached to the thumb.

Referring now to FIG. 2, the thumb 70 extends longitudinally from the bucket pin 62 along axis L. A rear portion 74 of the thumb 70 is provided with a pair of parallel, spaced-apart apertured ears 72, 72' for transverse insertion of the bucket mount pin 62, as may be seen in underside plan view in FIG. 4. The ears 72, 72' extend rearwardly from the rear 81 of the thumb 70. thumb 70 further comprises a body portion 78 which, as viewed from the underside thereof, is defined by a parallel pair of longitudinal walls 93, 93', a transverse wall 95 extending between the longitudinal walls 93, 93' at a forward portion 76 of the thumb 70, and extends to the body rear 81. The forward portion 76 of the thumb 70 further comprises a parallel array of four spaced-apart, substantially identical fingers 71, which fingers are reinforced by gussets 101 extending forwardly from the transverse wall 95. Each of the fingers 71 is an elongated strip formed from metal plate and having a downwardly-curved tooth end 71T for tearing into soil and debris, as may best be seen in FIG. 5.

Figure 3:
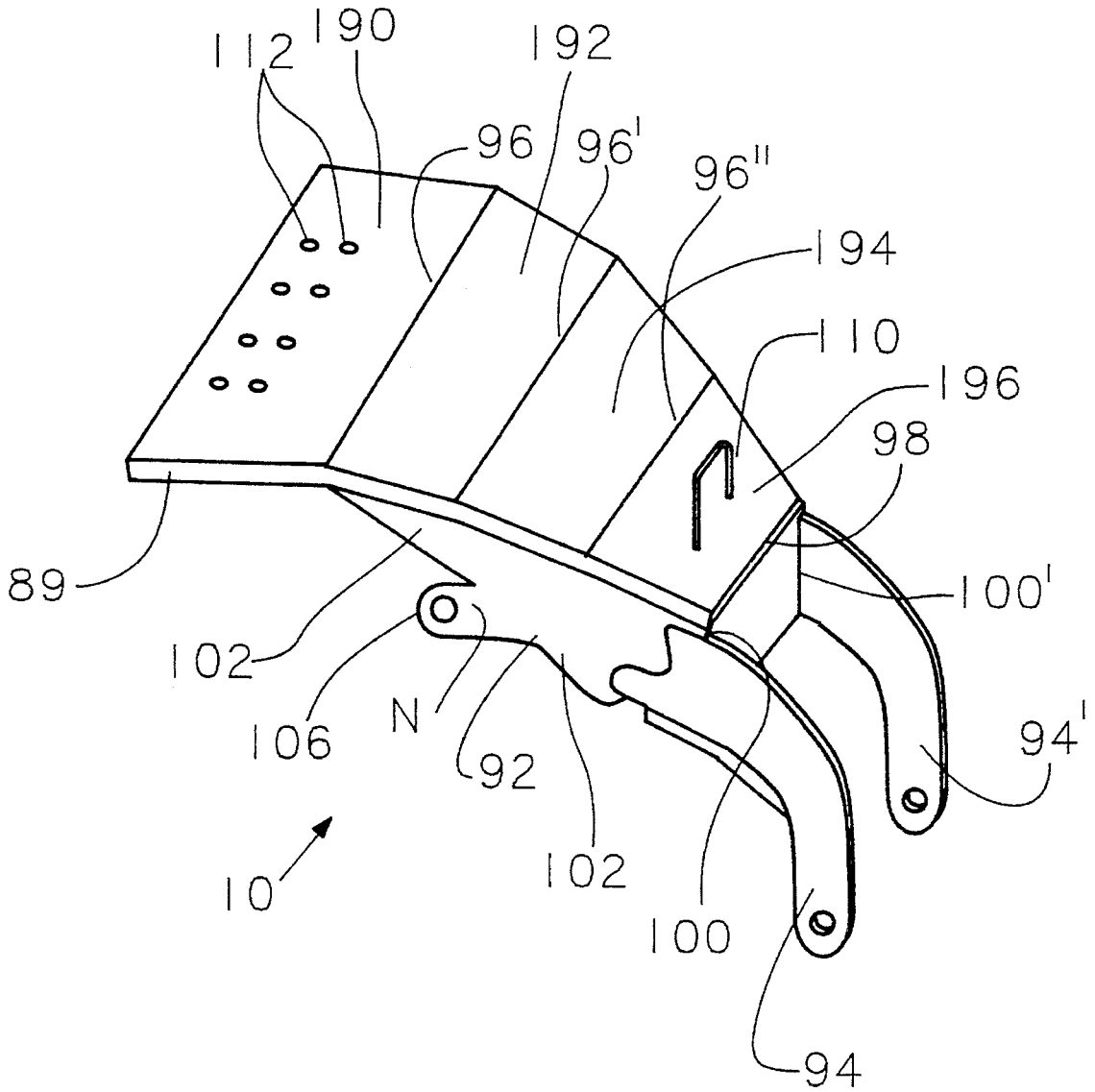
FIG. 3 is a left-frontal perspective view of the grapple mount.
Figure 4:
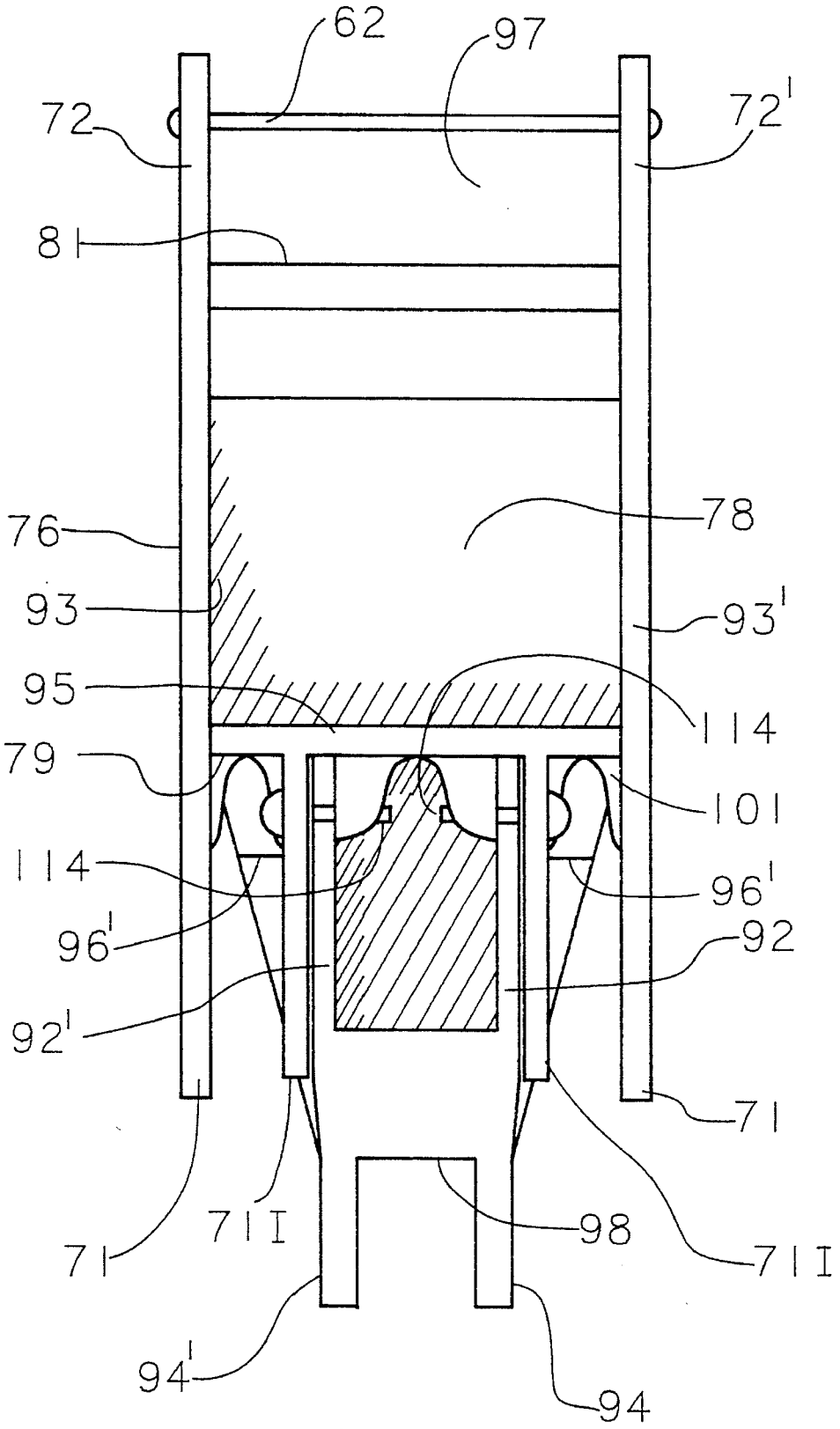
FIG. 4 is an underside plan view of the thumb and grapple mount, with the grapple removed, as viewed in a direction normal to the longitudinal axis L of the thumb, showing an outline of the flared portion of the cowl of the mount by dashed lines.
Figure 5:
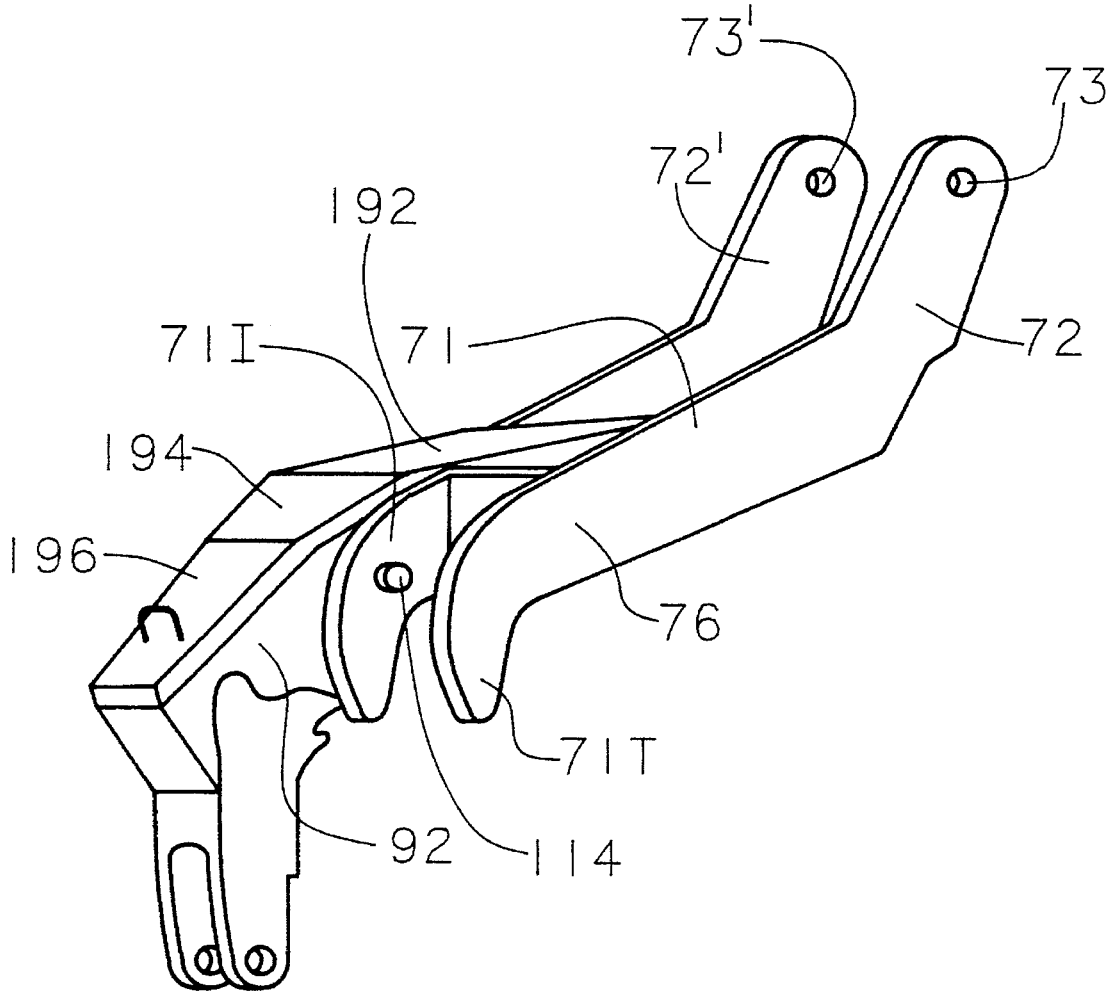
FIG. 5 is a right-frontal perspective view of the thumb, removed from the excavator arm, with the grapple mount attached.

Referring now to FIG. 3, my grapple mount 10 comprises a cowl 89, a pair of parallel walls 92, 92' that depend perpendicularly from the cowl 89, and a pair of apertured ears 94, 94' that are contiguous with walls 92, 92', respectively, and project forwardly and downwardly therefrom. Referring to FIGS. 3–5, it may be seen that the cowl 89 is a metal plate convexly and progressively bent from rear to front at spaced-apart, transverse creases 96, 96', 96" thereby defining a base plate 190, a rear plate 192, a central plate 194, and a forward plate 196, whereby the cowl 89, when in use, is adapted to closely overlie the body 78 and fingers 71 of the thumb 70. The cowl 90 is outwardly flared from front to rear, that is, to the rearmost crease 96, such that the width of the base plate 190 of the cowl 89 is substantially equal to the width of the thumb 70. The front margin 98 of the forward plate 196 of the cowl 89 is substantially equal to the distance between the two inner fingers 71 of the thumb 70.

The walls 92, 92', which are identically-shaped, are metal plates having straight front margins 100, 100', normal to the front margin 98 of the forward plate 196, and a lower margin 102 that is upwardly oblique from front to rear and terminating at crease 96, whereby each wall is substantially triangular in plan form. An apertured ear 106, 106' projects rearwardly from a central portion of each wall 92, 92'. The regions of intersection of the lower margin 102, 102' with the ears 106, 106' therefore, form notches N adapted for receiving the gussets 101 adjacent to the inner two fingers 71I of the thumb 70. In order to connect the grapple mount 10 to the thumb 70, however, it is first necessary to create a transverse bore through the two interior fingers 71I; this permits insertion of pins 114 through said bores and through apertured ears 106, 106' to attach the grapple mount 10 to a forward portion of the thumb 70. The base plate 190 includes a plurality of apertures 112 for insertion of bolts (not shown) by which to connect the grapple mount 10 to the body 78 of the thumb 70. Attached to the forward plate 196 is a hose stay 110 in the form of an inverted U.

Figure 6:
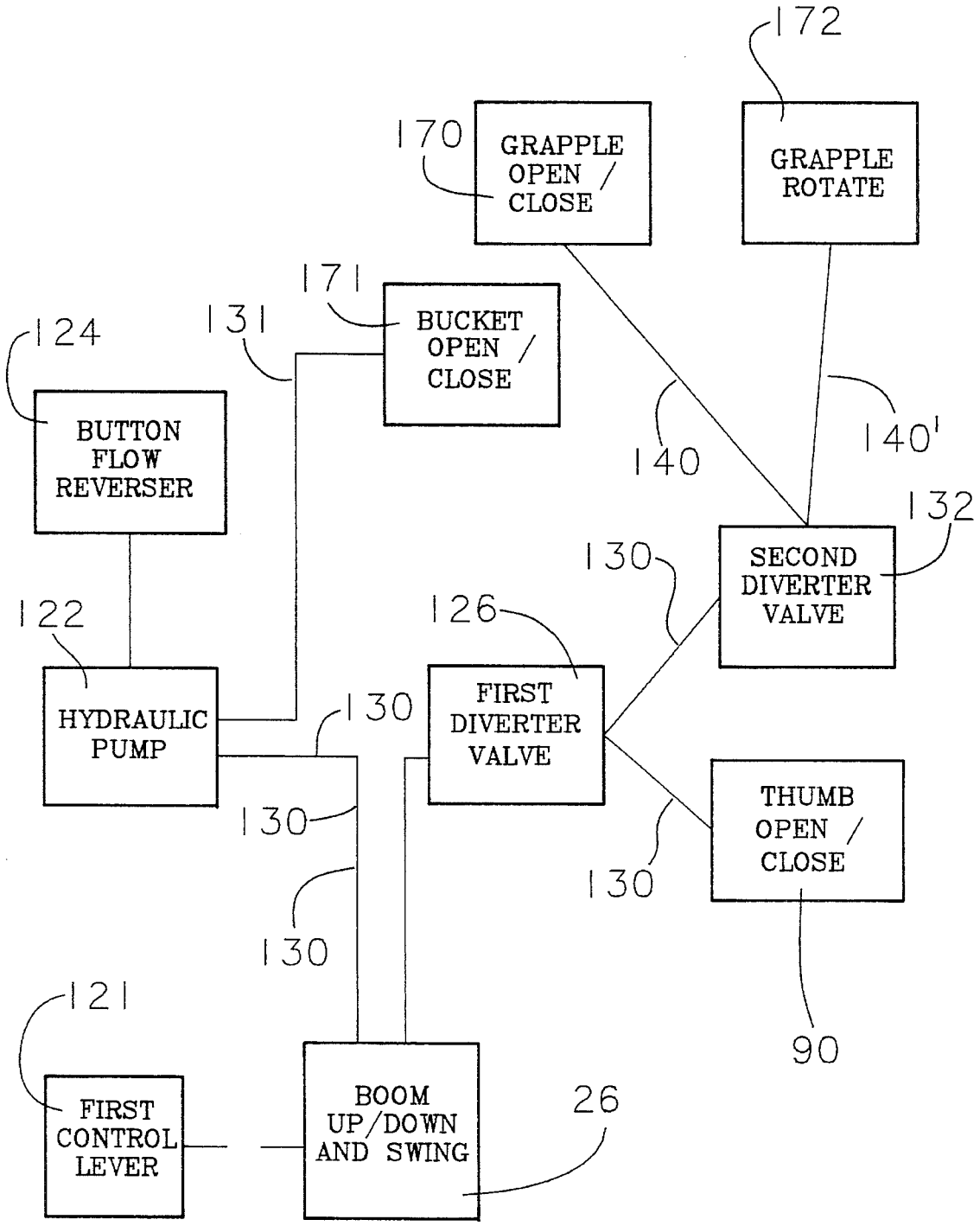
FIG. 6 is a schematic diagram of the hydraulic system of the excavator as modified by the invention.

The excavator of the kind described comes equipped with hydraulic line controls in the cab 27: a first lever 121 controls up and down movements of the boom 25 and left-and-right swings of the boom; a second lever controls arm and bucket functions, and a thumb control valve 143 controls the thumb 70. A button trigger 124 on the first lever 121' reverses hydraulic flow. Right and left pedals control forward, reverse and counterrotation movements. It is necessary to modify the hydraulic system of the excavator 20 in order to provide hydraulic actuation to a grapple 35 that is installed on the excavator 20 by means of the grapple mount 10. The apparatus of the present invention includes components that modify the hydraulic system of the excavator to provide hydraulic actuation for alternately opening and closing movements of the grapple and rotation of the grapple 35. As shown diagrammatically in FIG. 6, the modified hydraulic system includes a hydraulic pump 122 that provides hydraulic fluid under pressure to the thumb 70 through hydraulic line 130 in a flow direction determined by the status of the button flow reverser 124, and a first control lever 121 that controls up and down and swing movements of the boom 26. The excavator 20 also comes equipped with another hydraulic line 131 to provide hydraulic fluid under pressure for opening and closing the bucket 60.

Figure 7:
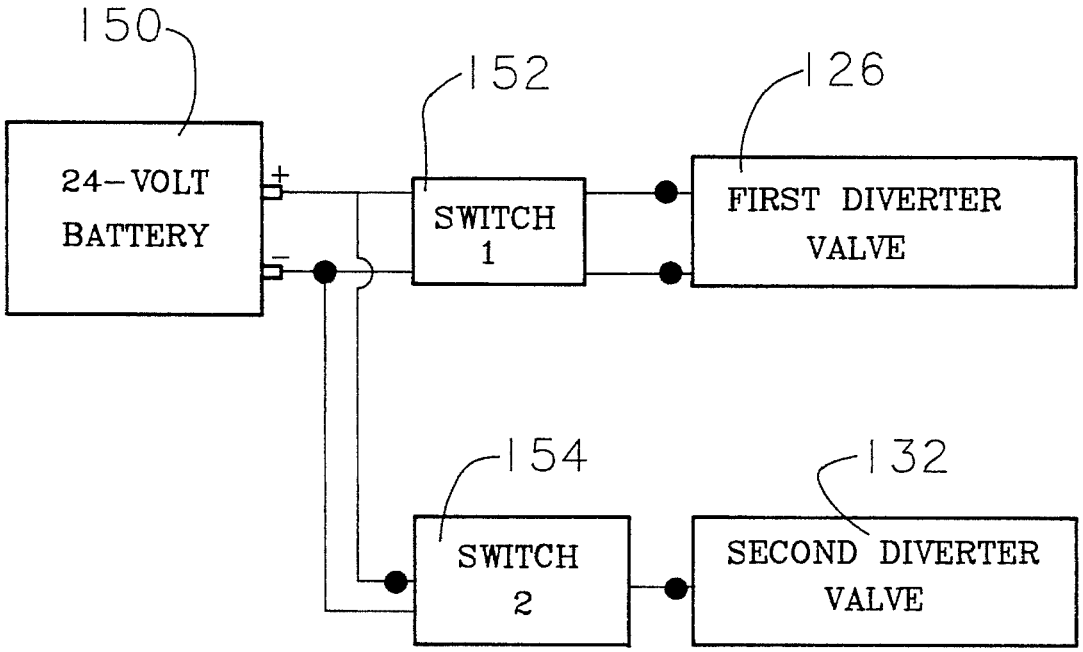
FIG. 7 is a schematic wiring diagram for the electrically actuated first and second diverter valves. The terms "front" and "forward" as used herein generally refer to the right portions of the excavator as illustrated in FIG. 1, except that in reference to the attachments to the boom, those terms shall refer to the direction defined by the sequence progressing from the boom through the arm, thumb, and grapple mount, in that order; similarly, the terms "rear" and "rearward" refer to the left portions of the excavator so illustrated, except that in reference to the attachments to the boom, those terms shall refer to the direction defined by the reverse sequence.

According to the present invention, a first diverter valve 126, however, is inserted in series with hydraulic line 137 for diverting hydraulic fluid, under control of operator selectable settings of a first electrical switch (not shown) mounted in the cab 27, from the thumb 70, where it otherwise would actuate the thumb open/close cylinder 90 to cause the thumb 70 to open and close, through hydraulic line 137' to a second diverter valve 132. The second diverter valve 132, under control of operator selectable settings of a second electrical switch (not shown) mounted in the cab, diverts the fluid either to hydraulic line 140 to actuate opening and closing movements of the grapple 35 by means of cylinder 170 or through line 140' to actuate grapple hydraulic motor 172 for rotational movements of the grapple 35. The first and second diverter valves are two-position, electrically-actuated hydraulic valves, such as *Valvoil DF 20/6A 18E, Ouebec, Canada*. Referring to FIG. 7, a 24-volt electric battery 150 wired in series with a first, two-position electric switch 152 energizes the first diverter valve 126 to switch alternately between permitting fluid flow through line 137 and line 137'. Similarly, the battery 150 wired in series with a second, two-position electric switch 154 energizes the second diverter valve 132 to switch alternatively between permitting hydraulic fluid to flow through line 140 and line 140'. The first and second electric switches 152, 154 are preferably mounted in the cab 24 on the first and second levers, respectively.

For use in clearing roads in forested areas, the bucket 60 and the thumb 70 are both mounted on the arm 32 by means of pin 62. When it is desired to use a grapple to remove logs and stumps, the ears 106, 106' of the grapple mount 10 are placed between the interior teeth 71I of the thumb 70 and secured in position by pins 114, and the cowl 89 is bolted to the thumb 70. A drop link 160 is attached to ears 94, 94' by means of a grapple pin 162 to which a grapple 35 is attached, thereby suspending the grapple 35 from the thumb 70. With the first switch 152 in a first position, the first diverter valve 126 routes hydraulic fluid to the thumb 70 so that the operator may then manipulate the first and second levers and the button flow reverser in the cab to position the grapple by vertical and horizontal movements of the boom, as well as by vertical movements of the thumb 70. To open the grapple 35 preparatory to grasping a log, the first switch 152 is flipped to a second position, whereby the first diverter valve 126 routes hydraulic fluid to the second diverter valve 132, and the second switch 154 is placed in a first position whereby the second diverter valve 132 routes hydraulic fluid to the grapple open/close cylinder 170. To close the grapple 35 around the log, the button flow reverser 124 is depressed. If it is desired to rotate the grapple 35, however, the second switch 154 is placed in a second position thereby causing the second diverter valve 132 to route hydraulic fluid to the grapple rotate motor 172.

Various details of the invention may be changed without departing from its scope. For example, the first and second diverter valves could be inserted into the hydraulic line 131 for the bucket instead of in the hydraulic line for the thumb 130. Furthermore, the description of the preferred embodiment according to the present invention is provided for the purpose of illustration only and not for the purpose of limitation the invention being defined by the claims.

I claim:

1. Apparatus for attachment of a grapple to an excavator equipped with a boom, an arm, a thumb having inner and outer teeth reinforced by gussets and a transverse bore through the inner teeth, and a hydraulic system for controlling movements of the boom and the thumb, comprising:

(a) a cowl, including a base plate portion having a plurality of holes for attachment by bolts to a rear upper surface of the thumb;

a convex portion attached to the base plate portion, including (1) a rear plate;

(2) a forward plate, and (3) a central plate that joins the rear plate and forward plates;

(b) a pair of spaced-apart walls depending from the convex portion of the cowl and notched to receive the gusseted inner teeth of the thumb;

(c) a first pair of spaced-apart, forwardly projecting, apertured ears;

(d) a second pair of spaced-apart, rearwardly projecting, apertured ears attached to the walls;

(e) thumb mount pins for insertion through the apertures of the first pair of ears and through the transverse bore of the inner teeth of the thumb;

(f) a grapple mount pin for insertion through the apertures of the second pair of ears; and (g) hydraulic control means for converting the hydraulic system for controlled actuation of opening, closing and rotational movement of a grapple.

2. The apparatus of claim 1, wherein the convex portion of the cowl is inwardly flared in the forward direction.

3. The apparatus of claim 1, wherein the cowl is progressively bent through obtuse angles at a first, second, and third transverse crease.

4. The apparatus of claim 1, wherein the hydraulic control means includes:

(a) a first diverter valve having a first operator selectable position for directing hydraulic fluid toward a thumb open/close cylinder and a second operator selectable position for directing hydraulic fluid toward a grapple; and (b) a second diverter valve connected by flexible conduit to the first diverter valve and having a first operator selectable position for directing hydraulic fluid to a grapple open/close cylinder for actuating opening and closing movements of the grapple, and a second operator selectable position for directing hydraulic fluid to a qrapple rotate motor for actuating rotation of the grapple.

5. The apparatus of claim 4, wherein the first and second diverter valves are electrically actuated hydraulic valves, and wherein the hydraulic control means further comprises:

(a) an electric power source for energizing the diverter valves;

(b) a first control switch connected to the power source and wired in series with the first diverter valve, and having operator selectable positions for alternately directing hydraulic fluid to the thumb open/close cylinder or to the second diverter valve; and (c) a second control switch connected to the power source and wired in series with the second diverter valve, and having operator selectable positions for alternately directing hydraulic fluid to actuate opening and closing movements of the grapple or to actuate rotation of the grapple.

* * * * *